US011289833B2

(12) United States Patent
Wu et al.

(10) Patent No.: US 11,289,833 B2
(45) Date of Patent: Mar. 29, 2022

(54) ELECTRICAL CONNECTOR AND CONNECTOR ASSEMBLY

(71) Applicant: LOTES CO., LTD, Keelung (TW)

(72) Inventors: Yao Wu, Keelung (TW); Wen Chang Chang, Keelung (TW); Biao Zhang, Keelung (TW); Jia Xu Yin, Keelung (TW); Chong Cheng Liang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/030,859

(22) Filed: Sep. 24, 2020

(65) Prior Publication Data

US 2021/0328369 A1 Oct. 21, 2021

(30) Foreign Application Priority Data

Apr. 20, 2020 (CN) ..... 202010311135.5

(51) Int. Cl.
*H01R 12/58* (2011.01)
*H01R 13/6471* (2011.01)

(52) U.S. Cl.
CPC ..... *H01R 12/58* (2013.01); *H01R 13/6471* (2013.01)

(58) Field of Classification Search
CPC H01R 13/6471; H01R 12/721; H01R 12/737; H01R 13/6587; H01R 12/716
See application file for complete search history.

(56) References Cited

U.S. PATENT DOCUMENTS

| | | | | |
|---|---|---|---|---|
| 7,727,028 | B1 * | 6/2010 | Zhang | H01R 12/716 439/108 |
| 7,963,806 | B1 * | 6/2011 | Scott Kline | H01R 13/642 439/660 |
| 9,601,851 | B2 * | 3/2017 | Jacoby | H01R 12/721 |
| 11,151,300 | B2 * | 10/2021 | Lloyd | G06F 30/373 |
| 11,152,729 | B2 * | 10/2021 | Martens | H01R 13/6587 |
| 2003/0176110 | A1 * | 9/2003 | Wu | H01R 13/6471 439/660 |

(Continued)

FOREIGN PATENT DOCUMENTS

| | | | |
|---|---|---|---|
| CN | 1617396 | A | 5/2005 |
| CN | 100546105 | C | 9/2009 |

(Continued)

*Primary Examiner* — Truc T Nguyen
(74) *Attorney, Agent, or Firm* — Locke Lord LLP

(57) ABSTRACT

An electrical connector includes a base and a row of conductive terminals, including at least one pair of differential signal terminals and multiple ground terminals. Each conductive terminal is in contact with a mating component. The conductive terminals include a terminal group having two ground terminals and one pair of differential signal terminals located between the two ground terminals. In the terminal group, a pitch between the pair of differential signal terminals is defined as a first pitch, a pitch between each differential signal terminal and its adjacent ground terminal is defined as a second pitch, and the first pitch is less than the second pitch. A pitch between another ground terminal adjacent to the terminal group and an adjacent ground terminal in the terminal group is defined as a third pitch, which is greater than the second pitch. The electrical connector and the mating component form a connector assembly.

20 Claims, 8 Drawing Sheets

(56) References Cited

U.S. PATENT DOCUMENTS

| | | | | |
|---|---|---|---|---|
| 2010/0068939 | A1* | 3/2010 | Xu | H01R 13/6471 439/651 |
| 2011/0201234 | A1* | 8/2011 | Long | H01R 12/721 439/630 |
| 2012/0214351 | A1* | 8/2012 | Shiratori | H01R 12/7082 439/692 |
| 2013/0115824 | A1* | 5/2013 | Briant | H01R 27/02 439/680 |
| 2013/0273781 | A1* | 10/2013 | Buck | H01R 13/6463 439/626 |
| 2013/0316585 | A1* | 11/2013 | McGrath | H01R 13/6471 439/629 |
| 2015/0079843 | A1* | 3/2015 | Nakashima | H01R 13/6461 439/607.09 |
| 2015/0162713 | A1* | 6/2015 | Tsai | H01R 12/724 439/676 |
| 2017/0365954 | A1* | 12/2017 | Chen | H01R 24/60 |
| 2019/0348783 | A1* | 11/2019 | Chen | H01R 13/6456 |
| 2020/0395698 | A1* | 12/2020 | Hou | H01R 13/6461 |
| 2021/0153351 | A1* | 5/2021 | Li | H01R 12/523 |
| 2021/0218193 | A1* | 7/2021 | Feng | H01R 13/6585 |

FOREIGN PATENT DOCUMENTS

| | | | |
|---|---|---|---|
| CN | 101685912 | B | 4/2013 |
| CN | 102290655 | B | 12/2013 |
| CN | 102195173 | B | 6/2015 |
| CN | 207052871 | U | 2/2018 |
| CN | 107658654 | B | 4/2019 |
| CN | 209860271 | U | 12/2019 |
| CN | 108448287 | B | 1/2020 |

* cited by examiner

A-A

B-B

ELECTRICAL CONNECTOR AND CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202010311135.5 filed in China on Apr. 20, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a connector assembly, and particularly to an electrical connector and a connector assembly having conductive terminals arranged at unequal pitches.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing connector assembly includes an electrical connector and a mating component mated with each other. A plurality of conductive terminals arranged at equal pitches in the electrical connector and a plurality of mating terminals arranged at equal pitches in the mating component are one-to-one conductively connected, thus facilitating signal transmission between the electrical connector and the mating component. For example, the electrical connector is a card edge connector meeting the Peripheral Component Interconnect Express (PCI-E) transmission protocol, and the mating component is an electronic card. According to the PCI-E standard, in the electronic card using the transmission protocol, the conductive pads are arranged at equal pitches. Thus, to match with the conductive pads at equal pitches, in the related art, the electrical connector matching with the standard PCI-E electronic card generally has the conductive terminals at equal pitches, and a distance between two adjacent conductive terminals is equal to a distance between two adjacent conductive pads. Further, the conductive terminals are used to provide conductive paths for transmission of electrical signals, and electrical coupling may be formed between each of the conductive terminals. With the updates and new versions of the PCI-E protocol, the signal transmission speed required becomes higher, and the electrical coupling formed by the conventional conductive terminals at equal pitches does not help the electrical connector to increase the signal transmission speed and to satisfy the requirement of the new version of the PCI-E protocol.

Therefore, a heretofore unaddressed need to design an improved electrical connector and a connector assembly exists in the art to address the aforementioned deficiencies and inadequacies.

SUMMARY

The present invention is directed to an electrical connector and a connector assembly having conductive terminals arranged at unequal pitches.

To achieve the foregoing objective, the present invention adopts the following technical solutions.

An electrical connector includes: a base; and a row of conductive terminals, provided in the base, and comprising at least one pair of differential signal terminals and a plurality of ground terminals, wherein each of the conductive terminals has a contact portion configured to be in contact with a mating component, the row of conductive terminals comprises at least one terminal group, and each of the at least one terminal group comprises two of the ground terminals and one pair of the at least one pair of differential signal terminals located between the two of the ground terminals; wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, and the first pitch is less than the second pitch; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

In certain embodiments, the base has an insertion slot downward concavely formed on an upper surface thereof and two side walls located at two opposite sides of the insertion slot, one of the two side walls has a plurality of accommodating holes correspondingly accommodating the row of the conductive terminals, the one of the two side walls further has a plurality of through holes corresponding to the accommodating holes, each of the through holes runs through an outer surface of the one of the two side walls and is in communication to a corresponding one of the accommodating holes, and in a vertical direction, a length of each of the through holes corresponding to one of the ground terminals is greater than a length of each of the through holes corresponding to one of the differential signal terminals.

In certain embodiments, the electrical connector further includes a shielding sheet, provided on the outer surface of the one of the two side walls and having a plurality of elastic sheets correspondingly protruding toward the ground terminals, wherein the elastic sheets pass through the through holes and are electrically connected to the corresponding ground terminals.

In certain embodiments, the shielding sheet has a plurality of teeth protruding downward from a lower edge thereof, and the teeth cover the through holes corresponding to the differential signal terminals.

In certain embodiments, each of the conductive terminals has a conductive portion configured to be in contact with a circuit board, and in the row of conductive terminals, a pitch between the two conductive portions of two adjacent ones of the conductive terminals is equal to a pitch between the two contact portions of the two adjacent ones of the conductive terminals.

In certain embodiments, each of the conductive terminals further has a connecting portion connecting the contact portion and the conductive portion, and in the row of conductive terminals, a pitch between the two connecting portions of the two adjacent ones of the conductive terminals is equal to the pitch between the two contact portions of the two adjacent ones of the conductive terminals.

In certain embodiments, the electrical connector includes two rows of conductive terminals, wherein the base has an insertion slot and two side walls, the insertion slot is downward concavely formed on an upper surface of the base along a vertical direction and extends along an elongated direction, the two side walls are located at two opposite sides of the insertion slot in a lateral direction, the elongated direction, the lateral direction and the vertical direction are perpendicular to one another, the two rows of conductive terminals are respectively provided on the two side walls, each row of conductive terminals, comprises a plurality of pairs of the differential signal terminals, and the pairs of differential signal terminals of the two rows of conductive terminals are provided to stagger in the elongated direction.

A connector assembly includes: an electrical connector, comprising a base and a row of conductive terminals provided in the base, wherein the row of the conductive terminals comprises at least one pair of differential signal terminals and a plurality of ground terminals; and a mating component mated with the electrical connector, wherein the mating component has a plurality of conductive pads arranged at equal pitches, each of the conductive terminals has a contact portion configured to be in contact with one of the conductive pads, the row of conductive terminals comprises at least one terminal group, and each of the at least one terminal group comprises two of the ground terminals and one pair of the at least one pair of differential signal terminals located between the two of the ground terminals; wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, and the first pitch is less than the second pitch and a pitch between two adjacent ones of the conductive pads; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

In certain embodiments, the base is provided with a plurality of accommodating holes to correspondingly accommodate the row of conductive terminals, a partition is provided between each two adjacent ones of the accommodating holes, a width of the partition between the one pair of differential signal terminals is defined as a first width, a width of the partition between each differential signal terminal of the one pair of differential signal terminals and the corresponding one of the two of the ground terminals adjacent thereto is defined as a second width, a width of the partition between the adjacent one of the two of the ground terminals in each of the at least one terminal group and the another ground terminal adjacent to each of the at least one terminal group is defined as a third width, the first width is less than the second width, and the second width is less than the third width.

In certain embodiments, before the row of conductive terminals are assembled to the base, the conductive terminals are connected to a strip at equal pitches.

In certain embodiments, the row of conductive terminals comprises two terminal groups adjacent to each other, and in the two terminal groups adjacent to each other, a pitch between the two ground terminals provided to be adjacent to each other is defined as the third pitch.

In certain embodiments, the mating component is an electronic card meeting with a Peripheral Component Interconnect Express (PCI-E) standard.

In certain embodiments, the base has an insertion slot downward concavely formed on an upper surface thereof and two side walls located at two opposite sides of the insertion slot, one of the two side walls has a plurality of accommodating holes correspondingly accommodating the row of the conductive terminals, the one of the two side walls further has a plurality of through holes corresponding to the accommodating holes, each of the through holes runs through an outer surface of the one of the two side walls and is in communication to a corresponding one of the accommodating holes, the electrical connector further comprises a shielding sheet provided outside the one of the two side walls, the shielding sheet has a plurality of elastic sheets correspondingly protruding toward the ground terminals, the elastic sheets pass through the through holes and are electrically connected to the corresponding ground terminals, and in a vertical direction, a length of each of the through holes corresponding to one of the ground terminals is greater than a length of each of the through holes corresponding to one of the differential signal terminals.

A connector assembly includes: an electrical connector, comprising a base and a row of conductive terminals provided in the base, wherein the row of the conductive terminals comprises at least one pair of differential signal terminals and a plurality of ground terminals; and a mating component mated with the electrical connector, wherein the mating component has a plurality of conductive pads provided in a row along an elongated direction, each of the conductive pads has a first virtual center line, each of the conductive terminals has a contact portion in contact with one of the conductive pads, the contact portion of each of the conductive terminals has a second virtual center line, the row of conductive terminals comprises at least one terminal group, and each of the at least one terminal group comprises two of the ground terminals and one pair of the at least one pair of differential signal terminals located between the two of the ground terminals; wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, the first pitch is less than the second pitch, and the second virtual center line of the contact portion of each of the conductive terminals is offset in the elongated direction from the first virtual center line of a corresponding one of the conductive pads toward a location between the contact portions of the one pair of differential signal terminals; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

In certain embodiments, the differential signal terminals and the ground terminals have identical structures.

In certain embodiments, each of the conductive terminals further has a conductive portion configured to be in contact with a circuit board and a connecting portion connecting the contact portion and the conductive portion, and a pitch between the two conductive portions of two adjacent ones of the conductive terminals is equal to a pitch between the two contact portions of the two adjacent ones of the conductive terminals, and is also equal to a pitch between the two connecting portions of the two adjacent ones of the conductive terminals.

In certain embodiments, the conductive portion of each of the conductive terminals has a third virtual center line, the circuit board has a plurality of conduction pads provided in a row in the elongated direction, each of the conduction pads has a fourth virtual center line, the conductive portion of each of the conductive terminals is electrically connected to a corresponding one of the conduction pads, and in each of the at least one terminal group, the third virtual center line of the conductive portion of each of the conductive terminals is offset in the elongated direction from the fourth virtual center line of the corresponding one of the conduction pads toward the location between the contact portions of the one pair of differential signal terminals.

In certain embodiments, the second virtual center line and the third virtual center line are provided on a same plane.

In certain embodiments, the conductive terminals are symmetrical relative to the plane defined by the second virtual center line and the third virtual center line.

In certain embodiments, the mating component is an electronic card meeting with a Peripheral Component Interconnect Express (PCI-E) standard.

Compared with the related art, certain embodiments of the present invention has the following beneficial effects. Firstly, the first pitch is less than the second pitch, and the second pitch is less than the third pitch. That is, in each terminal group, the one pair of differential signal terminals and the two ground terminals located at the two sides of the one pair of differential signal terminals are all close to the location between the one pair of differential signal terminals. Corresponding to two adjacent terminal groups, the two pairs of differential signal terminals are relatively away from each other, thereby reducing the parasitic capacitance coupling between the two pairs of differential signal terminals, and further reducing the interference between the two pairs of differential signal terminals. Secondly, in one terminal group, the one pair of differential signal terminals are close to each other, which helps the differential signal to maintain stable and to withstand the outside electromagnetic interference. Further, the one pair of differential signal terminals are close to each other, which helps the coupling electromagnetic field formed by each differential signal terminal of the one pair of differential signal terminals to the corresponding ground terminal to counteract with each other, reducing the outward interference of the one pair of differential signal terminals. Thirdly, in one terminal group, the ground terminals are also close to the one pair of differential signal terminals, facilitating shielding of the outer interference thereof, and the ground terminals are close to the one pair of differential signal terminals, increasing the coupling of the one pair of differential signal terminals to the ground terminals, and further enhancing the inhibition by the ground terminals to the common mode signal composition of the outer interference formed on the one pair of differential signal terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
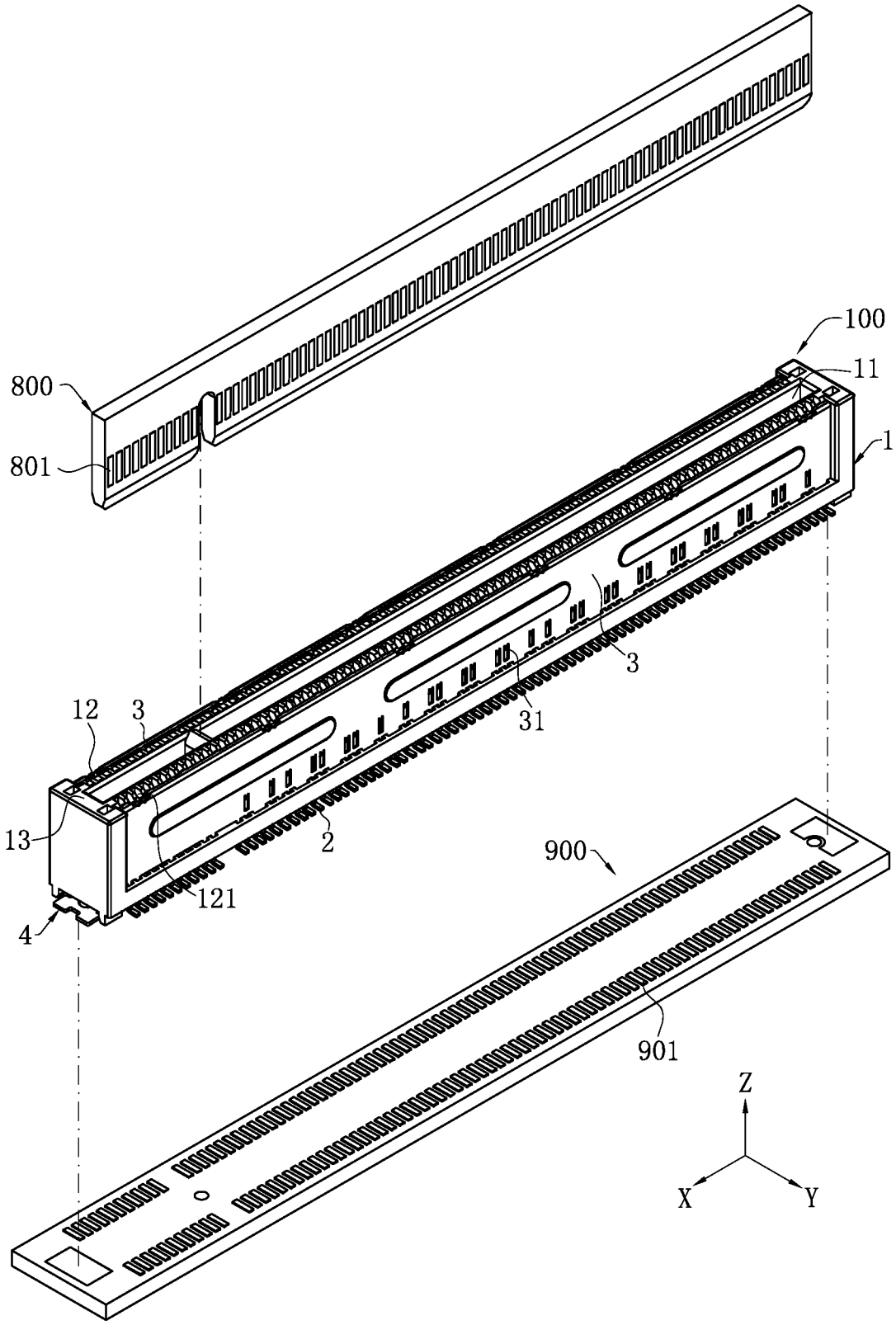
FIG. 1 is a perspective exploded view of a connector assembly according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector and a connector assembly.

Figure 2:
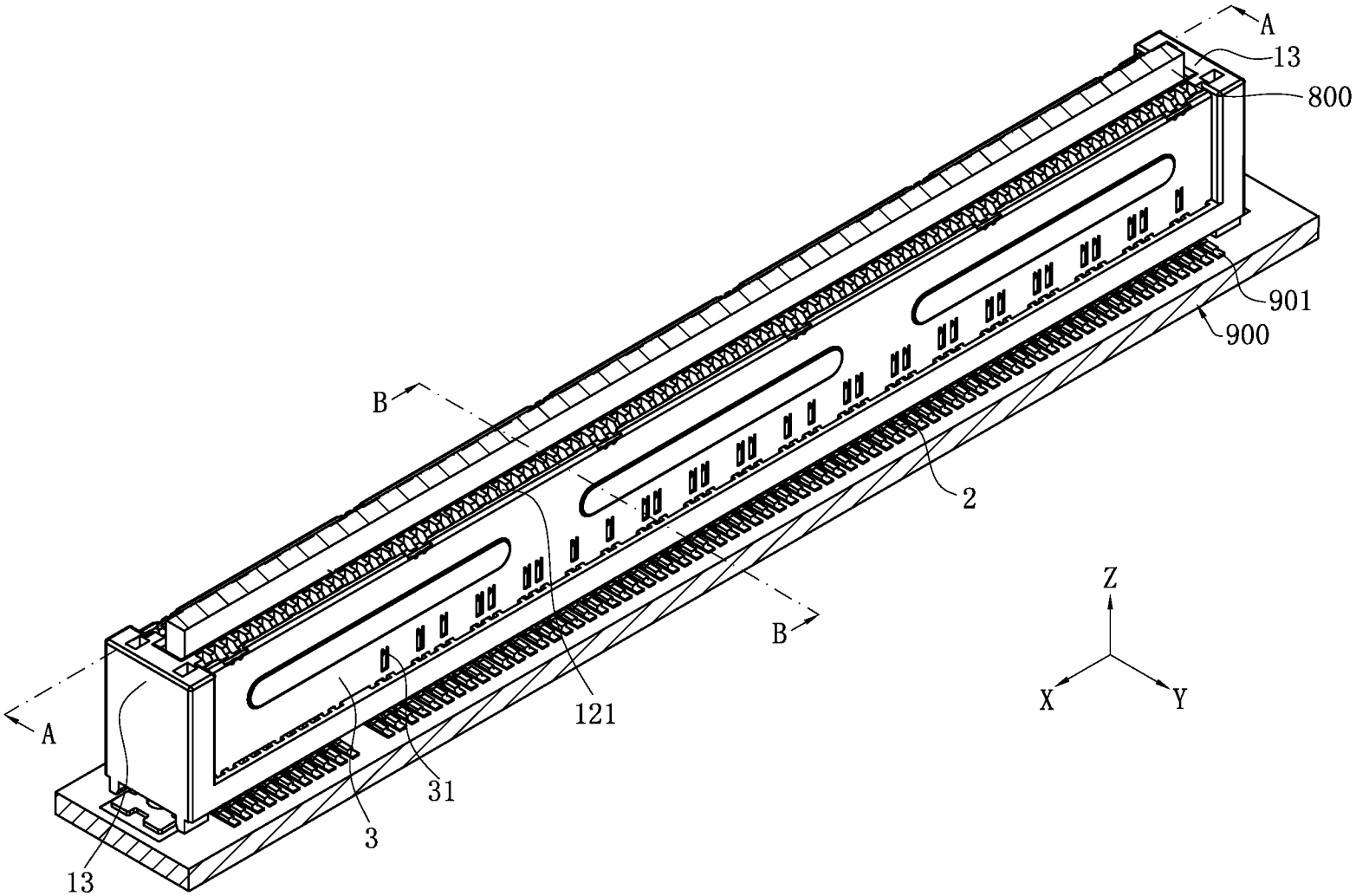
FIG. 2 is a perspective assembled view of FIG. 1.

FIG. 1 and FIG. 2 show a connector assembly according to certain embodiments of the present invention. The connector assembly includes an electrical connector 100, a mating component 800 and a circuit board 900. The mating component 800 forms electrical connection with the circuit board 900 through the electrical connector 100. In this embodiment, the electrical connector 100 is a vertical type card edge connector, which is mounted downward to the circuit board 900, and the mating component 800 is an electronic card meeting the PCI-E transmission protocol, which is inserted downward into the electrical connector 100. In the drawings of the present invention, the X-axis direction represents an elongated direction, the Y-axis direction represents a lateral direction, and a positive direction of the Z-axis direction represents an upward direction in a vertical direction. The elongated direction, the lateral direction and the vertical direction are perpendicular to one another.

As shown in FIG. 1 and FIG. 2, two opposite side surfaces of the card edge portion (that is, the lower end) of the mating component 800 respectively have a plurality of conductive pads 801 arranged at equal pitches along the elongated direction and provided in a row. An upper surface of the circuit board 900 is provided with a plurality of conduction pads 901. The conduction pads 901 are provided in two rows in the lateral direction. The conduction pads 901 of each row are arranged at equal pitches along the elongated direction. A pitch between two adjacent conductive pads 801 is equal to a pitch between two adjacent conduction pads 901. The term "pitch" hereinafter refers to a distance between two virtual center lines of two objects, and not a distance between edges of the two objects. Further, for convenience of descriptions hereinafter, the pitch between two adjacent conductive pads 801 is referred to as a standard pitch P0.

Figure 3:
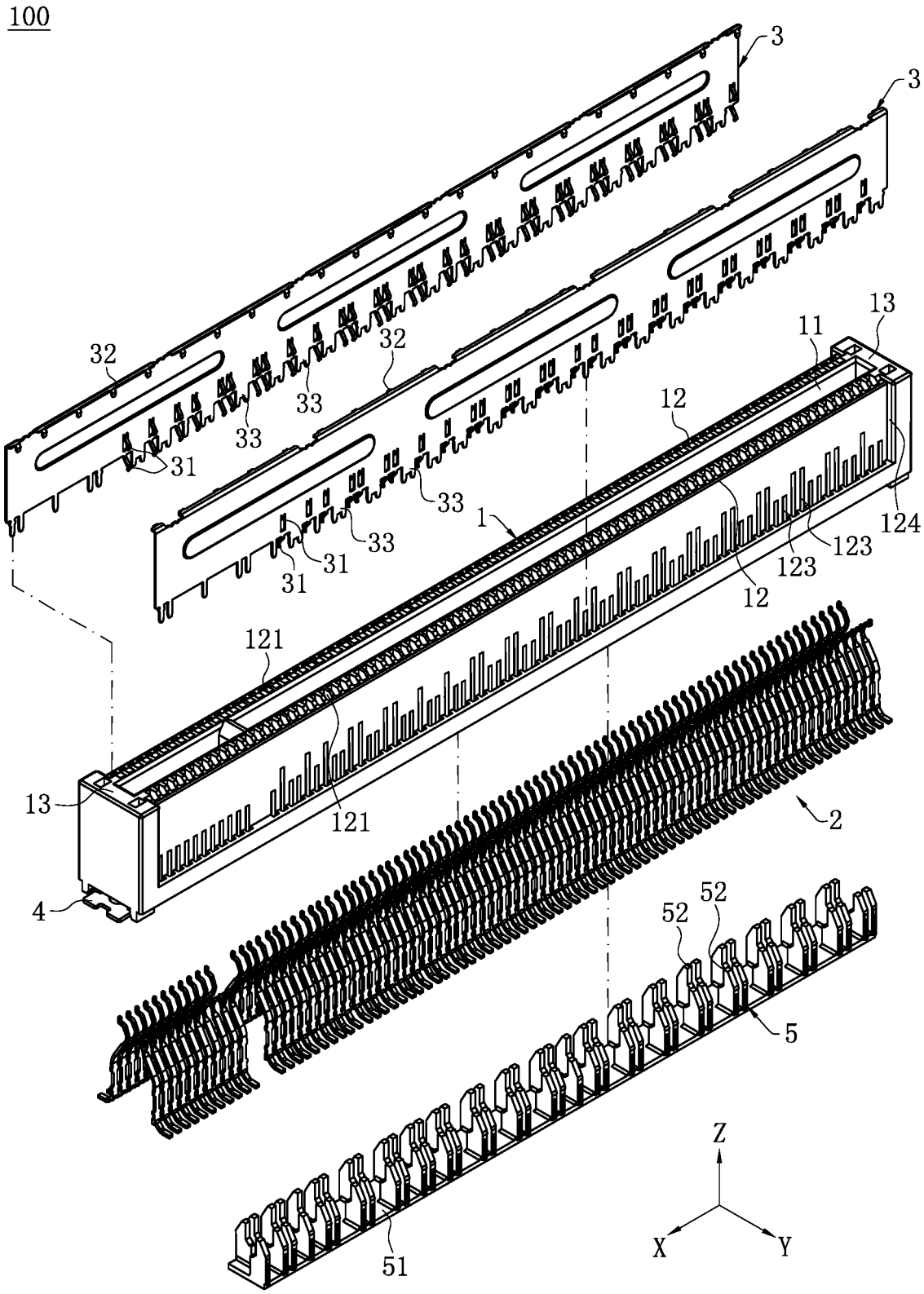
FIG. 3 is an exploded view of the electrical connector in FIG. 1.
Figure 6:
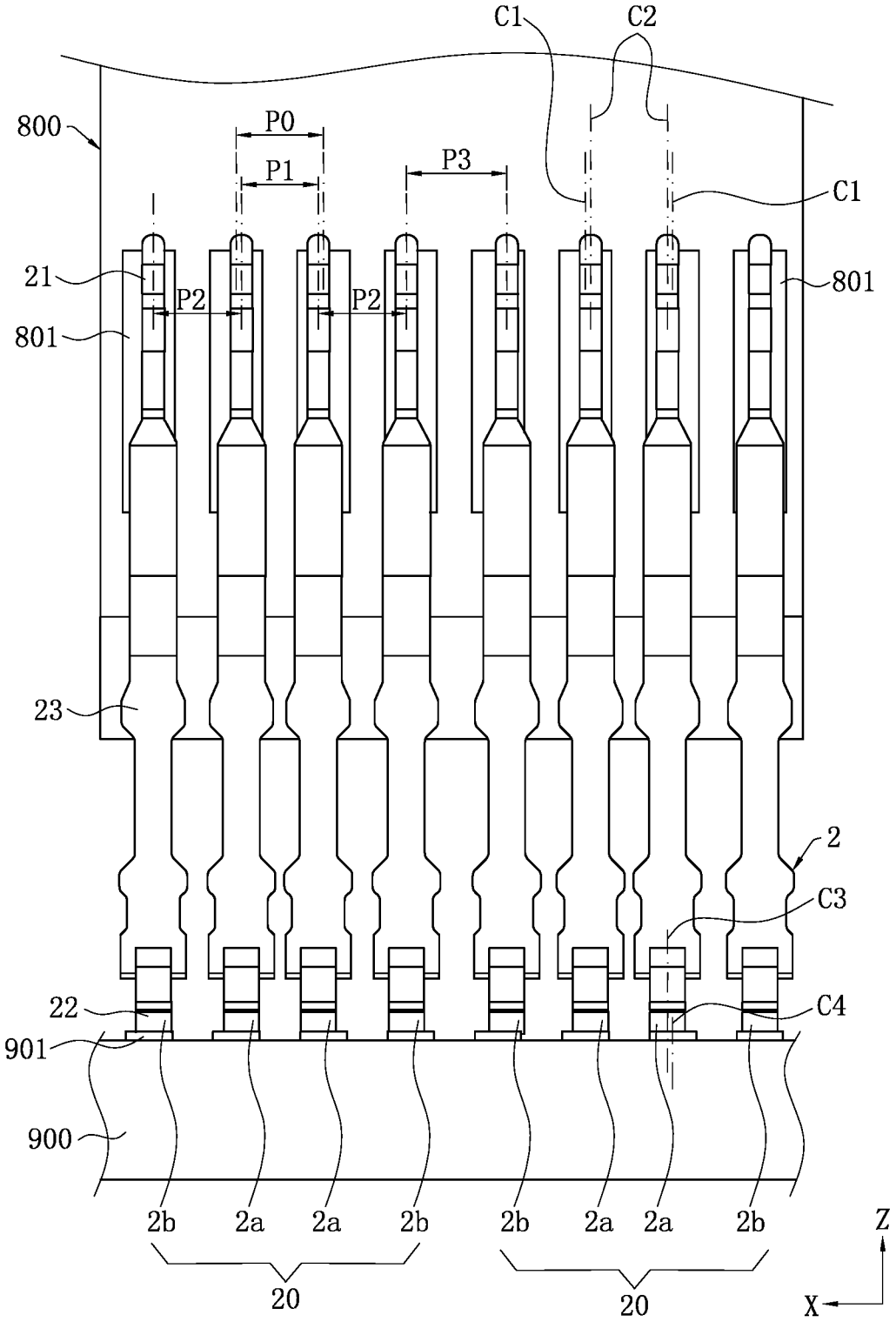
FIG. 6 is a schematic view of a conductive terminal in FIG. 2 simultaneously electrically connected to a mating component and a circuit board.

As shown in FIG. 2, FIG. 3 and FIG. 6, the electrical connector 100 mainly includes a base 1, a plurality of conductive terminals 2 and two shielding sheets 3. The base 1 is made of an insulating material. The conductive terminals 2 are provided in two rows on the base 1. The conductive terminals 2 are correspondingly in contact with the conductive pads 801 and electrically connected to the conduction pads 901, and the conductive terminals 2 in each row are arranged along the elongated direction and comprise a plurality of pairs of differential signal terminals 2*a* and a plurality of ground terminals 2*b*. The conductive terminals 2 in each row include a plurality of terminal groups 20. In this embodiment, each row of the conductive terminals 2 includes at least two terminal groups 20 successively arranged. Each terminal group 20 includes four conductive terminals 2 successively arranged, and specifically includes two ground terminals 2*b* and a pair of differential signal terminals 2*a* located between the two ground terminals 2*b*. The two shielding sheets 3 are provided at two opposite sides of the base 1.

Figure 4:
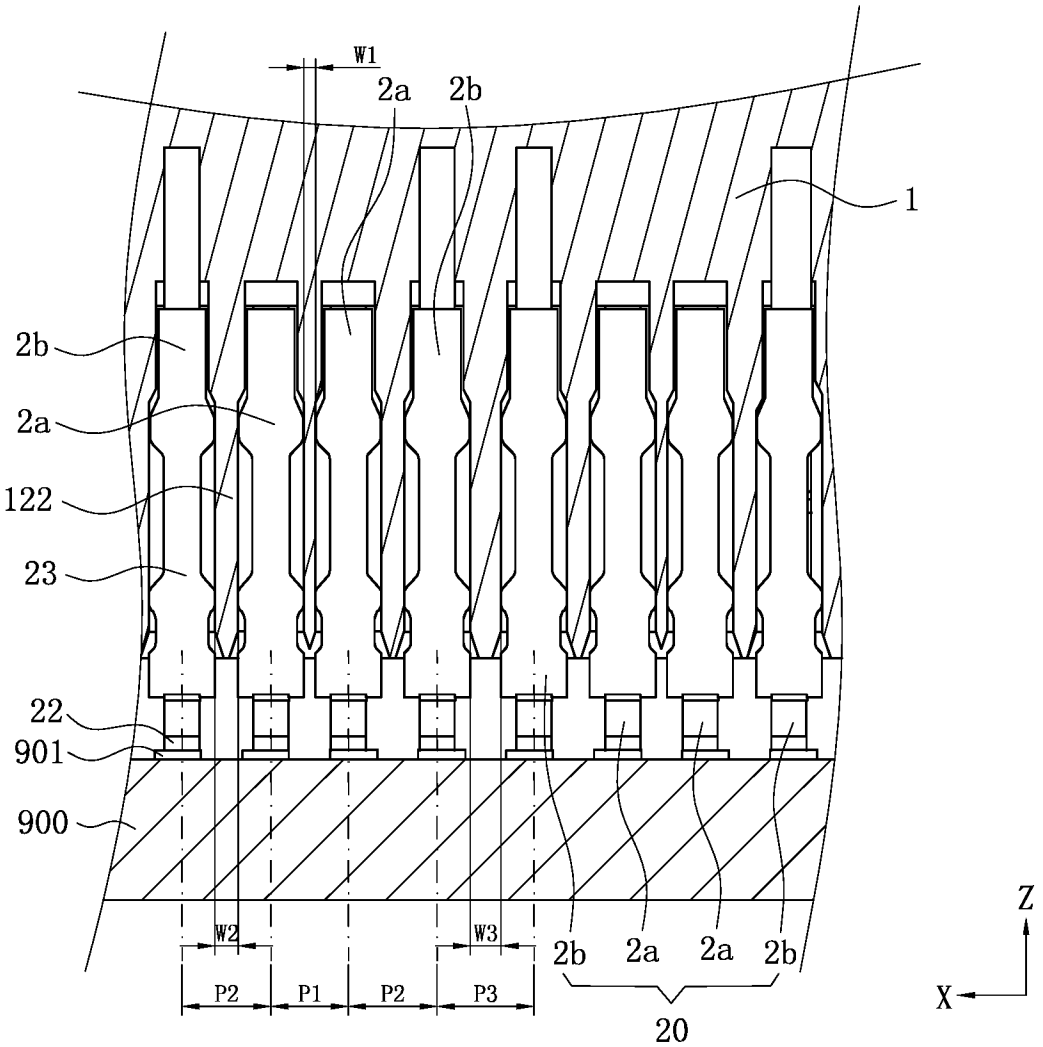
FIG. 4 is a partial sectional view of the connector assembly in FIG. 2 along a line A-A.

As shown in FIG. 2 to FIG. 4, the base 1 is mounted on the circuit board 900, and has an insertion slot 11 downward concavely formed on an upper surface thereof and extending along the elongated direction, two side walls 12 located at two opposite sides of the insertion slot 11 in the lateral direction, and two end walls 13 connecting the two side walls 12. The insertion slot 11 is used to accommodate the card edge portion of the mating component 800. Each of the side walls 12 has a plurality of accommodating holes 121 in communication with the insertion slot 11 to correspondingly accommodate one row of the conductive terminals 2. The accommodating holes 121 run vertically through an upper surface and a lower surface of the corresponding side wall 12. A partition 122 is provided between each two adjacent accommodating holes 121. A width of the partition 122 located between the pair of differential signal terminals 2*a* is defined as a first width W1. A width of the partition 122 located between each differential signal terminal 2*a* of the pair of differential signal terminals 2*a* and a ground terminal 2*b* adjacent thereto is defined as a second width W2. A width of the partition 122 located between a ground terminal 2*b* in the terminal group 20 and another ground terminal 2*b* adjacent to the terminal group 20 is defined as a third width W3. The first width W1 is less than the second width W2, and the second width W2 is less than the third width W3.

Figure 5:
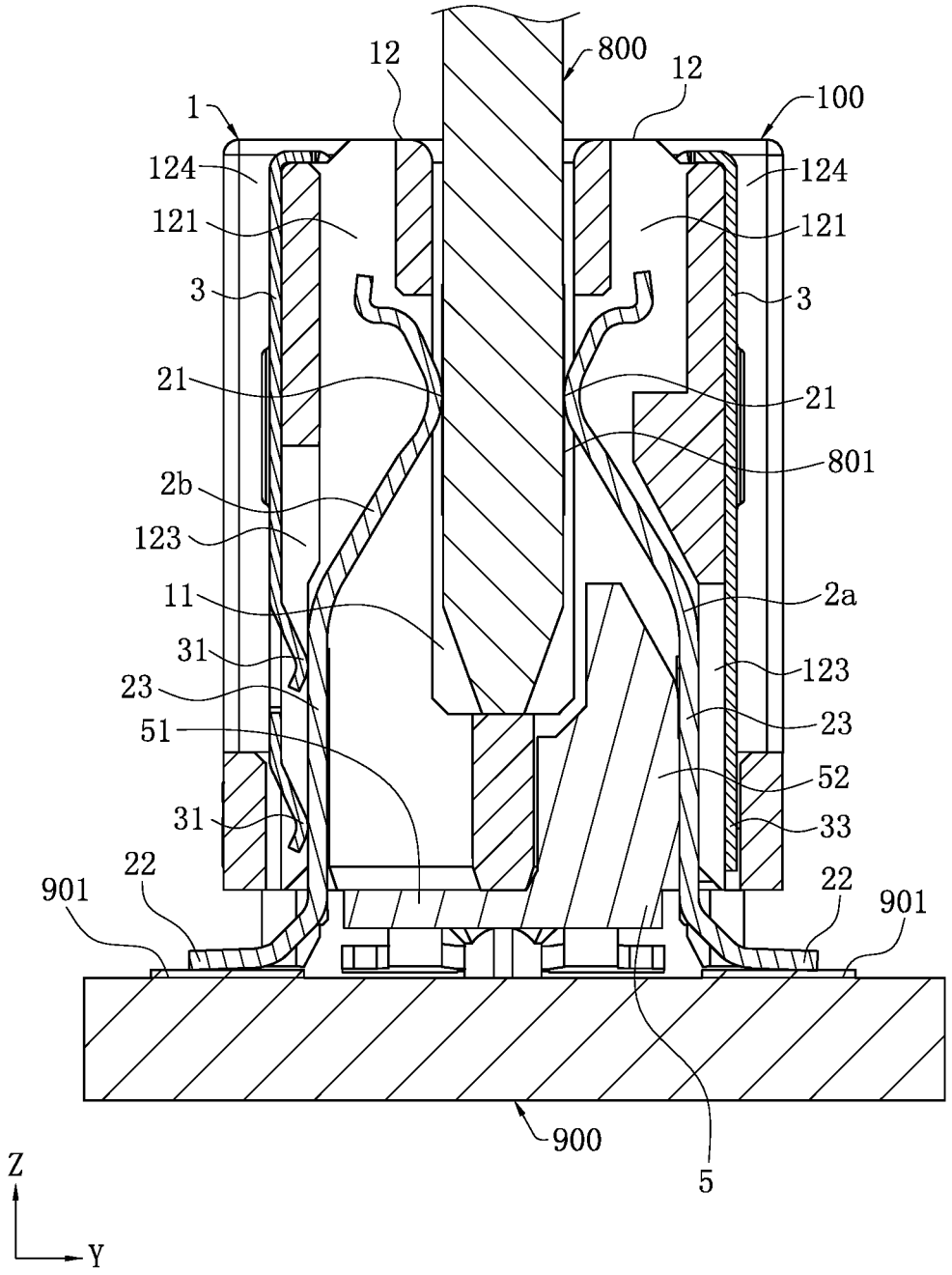
FIG. 5 is a sectional view of the connector assembly in FIG. 2 along a line B-B.

As shown in FIG. 3 and FIG. 5, each of the side walls 12 further has a plurality of through holes 123 corresponding to the accommodating holes 121. Each through hole 123 runs through an outer surface of the corresponding side wall 12 at a side away from the insertion slot 11, and is in communication with a corresponding accommodating hole 121. In the vertical direction, a length of each of the through holes 123 corresponding to the ground terminals 2*b* is greater than a length of each of the through holes 123 corresponding to the differential signal terminals 2*a*.

As shown in FIG. 2, FIG. 3 and FIG. 5, each of the side walls 12 has an accommodating portion 124 concavely formed on the outer surface thereof toward the insertion slot 11. The two shielding sheets 3 are correspondingly provided at the outer surfaces of the two side walls 12, and are correspondingly accommodated in the accommodating portions 124. The through holes 123 on a same side wall 12 are provided at the location of the corresponding accommodating portion 124. Each of the shielding sheets 3 has a plurality of elastic sheets 31 protruding toward the ground terminals 2*b*. Each of the elastic sheets 31 passes through a corresponding through hole 123 and forms electrical connection with a corresponding ground terminal 2*b*. In this embodiment, each ground terminal 2*b* is simultaneously in contact with two elastic sheets 31 arranged vertically. An upper edge of each shielding sheet 3 bends toward the insertion slot 11, and has a plurality of clamping hooks 32 protruding into a portion of the accommodating holes 121. A lower edge of each shielding sheet 3 has a plurality of teeth 33 protruding downward, and the teeth 33 cover the through holes 123 corresponding to the differential signal terminals 2*a*.

As shown in FIG. 3 and FIG. 5, in the conductive terminals 2, the differential signal terminals 2*a* and the ground terminals 2*b* have identical structures. Each conductive terminal 2 has a contact portion 21 configured to be in contact with a corresponding conductive pad 801, a conductive portion 22 configured to be electrically connected to a corresponding conduction pad 901, and a connecting portion 23 connecting the contact portion 21 and the conductive portion 22. As shown in FIG. 6, in a same terminal group 20, a pitch between the two contact portions 21 of the pair of differential signal terminals 2*a* is defined as a first pitch P1, and a pitch between the contact portion 21 of each differential signal terminal 2*a* of the pair of differential signal terminal 2*a* and the contact portion 21 of a corresponding ground terminal 2*b* adjacent thereto is defined as a second pitch P2. The second pitch P2 is greater than the standard pitch P0, and the first pitch P1 is less than the second pitch P2 and the standard pitch P0. Specifically, each of the conductive pads 801 has a first virtual center line C1, and the contact portion 21 of each of the conductive terminals 2 has a second virtual center line C2. The second virtual center line C2 of the contact portion 21 of each of the conductive terminals 2 is offset in the elongated direction from the first virtual center line C1 of a corresponding conductive pad 801 toward a location between the contact portions 21 of the pair of differential signal terminals 2*a*. Thus, for the two contact portions 21 of the pair of differential signal terminals 2*a*, a pitch between two first virtual center lines C1 is greater than a pitch between two second virtual center lines C2. In two adjacent terminal groups 20 of one row of the conductive terminals 2, a pitch between the two ground terminals 2*b* provided to be adjacent to each other is defined as the third pitch P3. Since each of these two ground terminals 2*b* is close to the differential signal terminals 2*a* in the same terminal group 20, the third pitch P3 is greater than the standard pitch P3, and is also greater than the second pitch P2.

As shown in FIG. 4 and FIG. 6, in one row of the conductive terminals 2, a pitch between the two conductive portions 22 of two adjacent conductive terminals 2 is equal to a pitch between the two contact portions 21 of the two adjacent conductive terminals 2, and a pitch between the two connecting portions 23 of the two adjacent conductive terminals 2 is equal to the pitch between the two contact portions 21 of the two adjacent conductive terminals 2.

Figure 7:
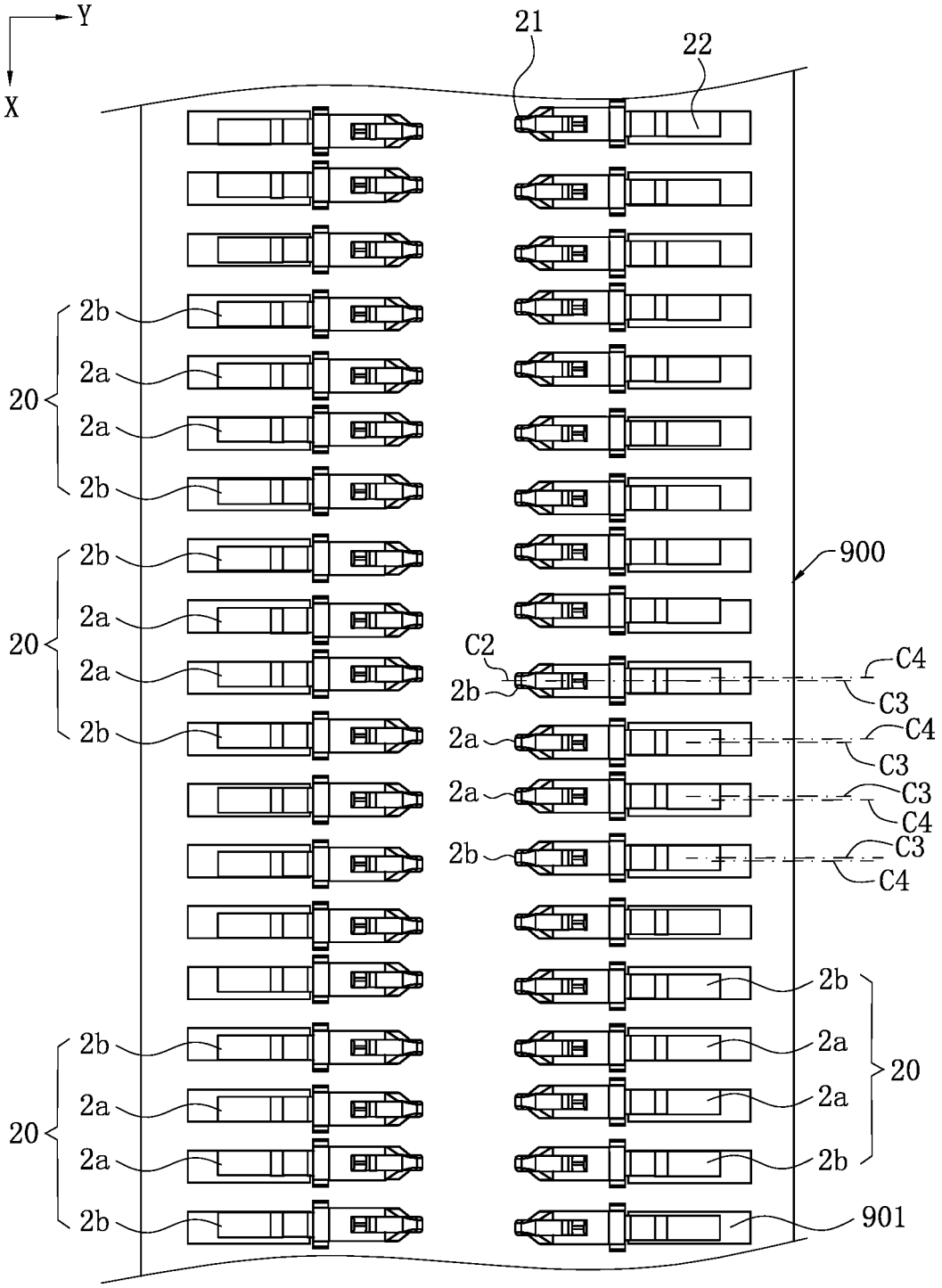
FIG. 7 is a top view of two rows of conductive terminals and the circuit board in FIG. 2.

As shown in FIG. 6 and FIG. 7, the conductive portion 22 of each of the conductive terminals 2 has a third virtual center line C3, and each of the conduction pads 901 has a fourth virtual center line C4. The pitch between two adjacent conduction pads 901 is equal to the pitch between two adjacent conductive pads 801. Thus, in the terminal group 20, for each differential signal terminal 2*a* of the pair of differential signal terminals 2*a*, the third virtual center line C3 of the conductive portion 22 is offset in the elongated direction from the fourth virtual center line C4 of a corresponding conduction pad 901 toward the location between the pair of differential signal terminals 2*a*. Accordingly, for the two conductive portions 22 of the pair of differential signal terminals 2*a*, a pitch between two third virtual center lines C3 is less than a pitch between two fourth virtual center lines C4.

As shown in FIG. 6 and FIG. 7, the second virtual center line C2 and the third virtual center line C3 of a same conductive terminal 2 are provided on a same plane. Each of the conductive terminals 2 are symmetrical relative to the plane defined by the second virtual center line C2 and the third virtual center line C3.

As shown in FIG. 7, the pairs of differential signal terminals 2*a* of the two rows of conductive terminals 2 are provided to stagger in the elongated direction.

Figure 8:
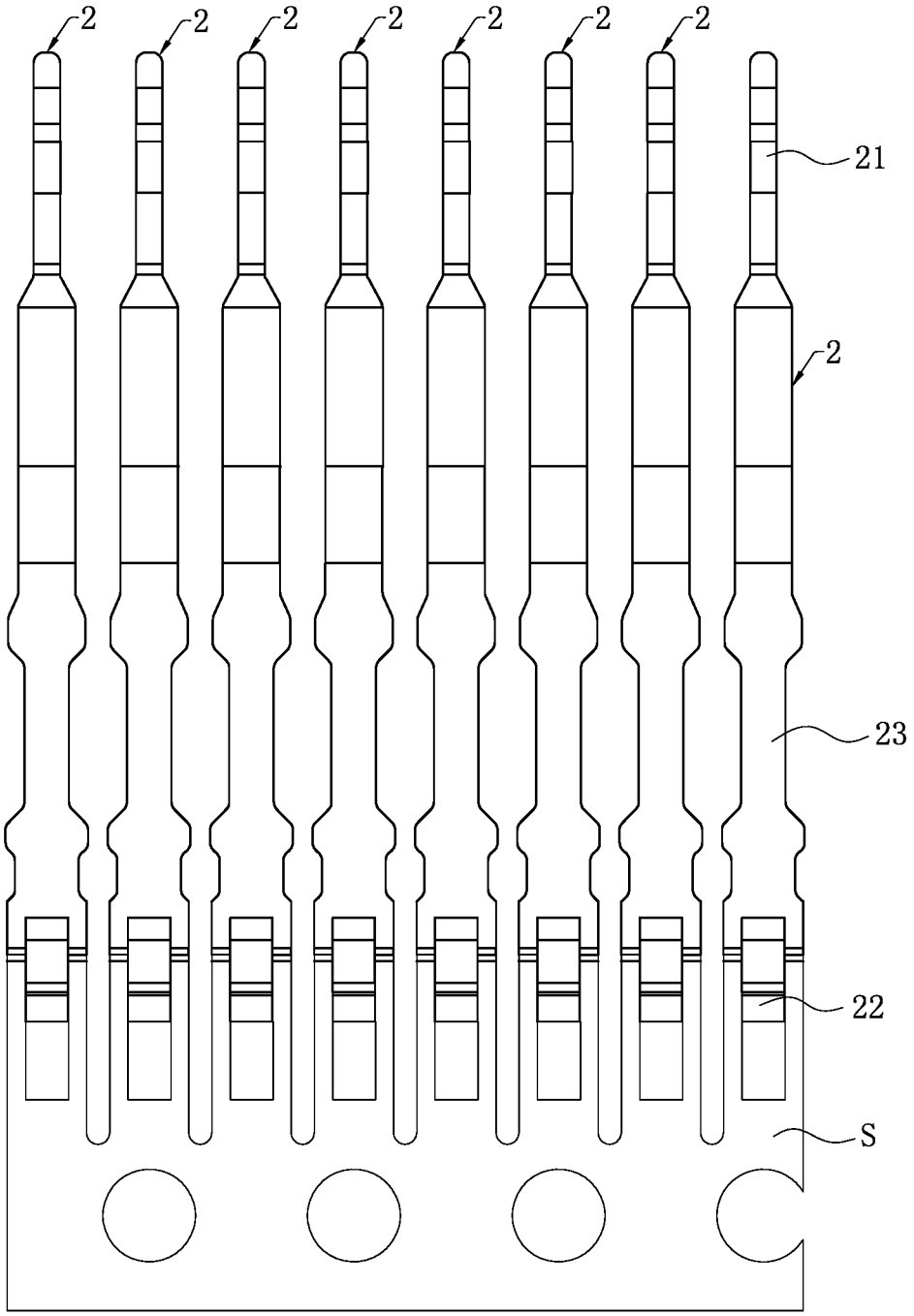
FIG. 8 is a schematic view of a row of conductive terminals in FIG. 3 being connected to a strip before being assembled to a base of the electrical connector.

As shown in FIG. 8, before each row of conductive terminals 2 are assembled to the base 1, the conductive terminals 2 are connected to a strip S at equal pitches. In the assembling process, the row of conductive terminals 2 are simultaneously inserted into the corresponding accommodating holes 121 at one side of the insertion slot 11. Each conductive terminal 2 is in interference fit with the corresponding accommodating hole 121 at the connecting portion 23 thereof. Each conductive terminal 2 is inserted along the partition 122 between two adjacent accommodating hole 121 (also referring to FIG. 3), and the partitions 122 have three different widths, in which the first width W1 is less than the second width W2 and the second width W2 is less than the third width W3.

Thus, the three types of partitions 122 respectively correspond to the three types of pitches of the terminals, forming the relationships that the first pitch P1 is less than the second pitch P2, and the second pitch P2 is less than the third pitch P3.

As shown in FIG. 3 and FIG. 5, the electrical connector 100 further has two soldering sheets 4 and a plug 5. The soldering sheets 4 are respectively fixed to the end walls 13, and by soldering the soldering sheets 4 to the circuit board 900, the retaining forces of the two elongated ends of the electrical connector 100 to the circuit board 900 are enhanced. The plug 5 is made of an insulating plastic, which includes a flat plate portion 51 and a plurality of fins 52 protruding upward from the flat plate portion 51. The fins 52 are provided in two rows in the lateral direction. The plug 5 is mounted to the base 1 upward from bottom thereof. The two rows of the fins 52 are located at two sides of the insertion slot 11. Each of the fins 52 only enters a corresponding accommodating hole 121 for a corresponding differential signal terminal 2*a*, and abuts the corresponding differential signal terminal 2*a*. The fins 52 protrude upward to pass beyond a bottom surface of the insertion slot 11.

The electrical connector and the connector assembly according to certain embodiments of the present invention have the following beneficial effects:

1. As shown in FIG. 6, in the connector assembly formed by the electrical connector 100 and the mating component 800, the conductive pads 801 arranged at equal pitches and the conductive terminals 2 arranged at unequal pitches are correspondingly in contact, such that the electrical connector 100 may be compatible to the electronic card meeting the PCI-E standard protocol in the electrical connection, and the conductive terminals 2 may also form the arrangement pitches that help the transmission of high frequency signals. Specifically, firstly, in each terminal group 20, the pair of differential signal terminals 2*a* and the two ground terminals 2*b* located at the two sides of the pair of differential signal terminals 2*a* are all close to the location between the pair of differential signal terminals 2*a* (as represented in that the first pitch P1 is less than the standard pitch P0, and the third pitch P3 is greater than the standard pitch P0). Thus, corresponding to two adjacent terminal groups 20, the two pairs of differential signal terminals 2*a* are relatively away from each other, thereby reducing the parasitic capacitance coupling between the two pairs of differential signal terminals 2*a*, and further reducing the interference between the two pairs of differential signal terminals 2*a*. Secondly, in one terminal group 20, the pair of differential signal terminals 2*nal* to maintain stable and to withstand the outside electromagnetic interference. Further, the pair of differential signal terminals 2*a* are close to each other, which helps the coupling electromagnetic field formed by each of the pair of differential signal terminals 2*a* to the corresponding ground terminal 2*b* to counteract with each other, reducing the outward interference of the pair of differential signal terminals 2*a*. Thirdly, in one terminal group 20, the ground terminals 2*b* are also close to the pair of differential signal terminals 2*a*, facilitating shielding of the outer interference thereof, and the ground terminals 2*b* are close to the pair of differential signal terminals 2*a*, increasing the coupling of the pair of differential signal terminals 2*a* to the ground terminals 2*b*, and further enhancing the inhibition by the ground terminals 2*b* to the common mode signal composition of the outer interference formed on the pair of differential signal terminals 2*a*.

2. The pairs of the differential signal terminals 2*a* of the two rows of conductive terminals 2 are provided to stagger in the elongated direction, reducing the interference of the different pairs of differential signal terminals 2*a* to each other in the lateral direction.

3. The plug 5 made of the insulating material is added between the two rows of the conductive terminals 2 in the lateral direction, thus increasing the dielectric coefficient of the medium between the two rows of the conductive terminals 2, and reducing the interference of the different pairs of differential signal terminals 2*a* to each other in the lateral direction. Further, the fins 52 enter the corresponding accommodating holes 121 accommodating the differential signal terminals 2*a*, thus adjusting the dielectric coefficient of the medium around the differential signal terminals 2*a*, such that the differential signal terminals 2*a* satisfy the high frequency requirement.

4. The length of each of the through holes 123 corresponding to the ground terminals 2*b* is greater than the length of each of the through holes 123 corresponding to the differential signal terminals 2*a*, thus enhancing the coupling of the differential signal terminals 2*a* to the ground terminals 2*b*, and further helping the inhibition to the common mode interference. By providing the teeth 33, the shielding areas of the shielding sheets 3 to the differential signal terminals 2*a* are increased, which helps reducing the outer environmental interference to the differential signal terminals 2*a*.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a base; and a row of conductive terminals, provided in the base, and comprising at least one pair of differential signal terminals and a plurality of ground terminals, wherein each of the conductive terminals has a contact portion configured to be in contact with a mating component, the row of conductive terminals comprises at least one terminal group, and each of the at least one terminal group comprises two of the ground terminals and one pair of the at least one pair of differential signal terminals located between the two of the ground terminals;

wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, and the first pitch is less than the second pitch; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

2. The electrical connector according to claim 1, wherein the base has an insertion slot downward concavely formed on an upper surface thereof and two side walls located at two opposite sides of the insertion slot, one of the two side walls has a plurality of accommodating holes correspondingly accommodating the row of the conductive terminals, the one of the two side walls further has a plurality of through holes corresponding to the accommodating holes, each of the through holes runs through an outer surface of the one of the two side walls and is in communication to a corresponding one of the accommodating holes, and in a vertical direction, a length of each of the through holes corresponding to one of the ground terminals is greater than a length of each of the through holes corresponding to one of the differential signal terminals.

3. The electrical connector according to claim 2, further comprising a shielding sheet, provided on the outer surface of the one of the two side walls and having a plurality of elastic sheets correspondingly protruding toward the ground terminals, wherein the elastic sheets pass through the through holes and are electrically connected to the corresponding ground terminals.

4. The electrical connector according to claim 3, wherein the shielding sheet has a plurality of teeth protruding downward from a lower edge thereof, and the teeth cover the through holes corresponding to the differential signal terminals.

5. The electrical connector according to claim 1, wherein each of the conductive terminals has a conductive portion configured to be in contact with a circuit board, and in the row of conductive terminals, a pitch between the two conductive portions of two adjacent ones of the conductive terminals is equal to a pitch between the two contact portions of the two adjacent ones of the conductive terminals.

6. The electrical connector according to claim 5, wherein each of the conductive terminals further has a connecting portion connecting the contact portion and the conductive portion, and in the row of conductive terminals, a pitch between the two connecting portions of the two adjacent ones of the conductive terminals is equal to the pitch between the two contact portions of the two adjacent ones of the conductive terminals.

7. The electrical connector according to claim 1, comprising two rows of conductive terminals, wherein the base has an insertion slot and two side walls, the insertion slot is downward concavely formed on an upper surface of the base along a vertical direction and extends along an elongated direction, the two side walls are located at two opposite sides of the insertion slot in a lateral direction, the elongated direction, the lateral direction and the vertical direction are perpendicular to one another, the two rows of conductive terminals are respectively provided on the two side walls, each row of conductive terminals, comprises a plurality of pairs of differential signal terminals, and the pairs of differential signal terminals of the two rows of conductive terminals are provided to stagger in the elongated direction.

8. A connector assembly, comprising:

an electrical connector, comprising a base and a row of conductive terminals provided in the base, wherein the row of the conductive terminals comprises at least one pair of differential signal terminals and a plurality of ground terminals; and a mating component mated with the electrical connector, wherein the mating component has a plurality of conductive pads arranged at equal pitches, each of the conductive terminals has a contact portion configured to be in contact with one of the conductive pads, the row of conductive terminals comprises at least one terminal group, and each of the at least one terminal group comprises two of the ground terminals and one pair of the at least one pair of differential signal terminals located between the two of the ground terminals;

wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, and the first pitch is less than the second pitch and a pitch between two adjacent ones of the conductive pads; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

9. The connector assembly according to claim 8, wherein the base is provided with a plurality of accommodating holes to correspondingly accommodate the row of conductive terminals, a partition is provided between each two adjacent ones of the accommodating holes, a width of the partition between the one pair of differential signal terminals is defined as a first width, a width of the partition between each differential signal terminal of the one pair of differential signal terminals and the corresponding one of the two of the ground terminals adjacent thereto is defined as a second width, a width of the partition between the adjacent one of the two of the ground terminals in each of the at least one terminal group and the another ground terminal adjacent to each of the at least one terminal group is defined as a third width, the first width is less than the second width, and the second width is less than the third width.

10. The connector assembly according to claim 9, wherein before the row of conductive terminals are assembled to the base, the conductive terminals are connected to a strip at equal pitches.

11. The connector assembly according to claim 8, wherein the row of conductive terminals comprises two terminal groups adjacent to each other, and in the two terminal groups adjacent to each other, a pitch between the two ground terminals provided to be adjacent to each other is defined as the third pitch.

12. The connector assembly according to claim 8, wherein the mating component is an electronic card meeting with a Peripheral Component Interconnect Express (PCI-E) standard.

13. The connector assembly according to claim 12, wherein the base has an insertion slot downward concavely formed on an upper surface thereof and two side walls located at two opposite sides of the insertion slot, one of the two side walls has a plurality of accommodating holes correspondingly accommodating the row of the conductive terminals, the one of the two side walls further has a plurality of through holes corresponding to the accommodating holes, each of the through holes runs through an outer surface of the one of the two side walls and is in communication to a corresponding one of the accommodating holes, the electrical connector further comprises a shielding sheet provided outside the one of the two side walls, the shielding sheet has a plurality of elastic sheets correspondingly protruding toward the ground terminals, the elastic sheets pass through the through holes and are electrically connected to the corresponding ground terminals, and in a vertical direction, a length of each of the through holes corresponding to one of the ground terminals is greater than a length of each of the through holes corresponding to one of the differential signal terminals.

14. A connector assembly, comprising:

an electrical connector, comprising a base and a row of conductive terminals provided in the base, wherein the row of the conductive terminals comprises at least one pair of differential signal terminals and a plurality of ground terminals; and a mating component mated with the electrical connector, wherein the mating component has a plurality of conductive pads provided in a row along an elongated direction, each of the conductive pads has a first virtual center line, each of the conductive terminals has a contact portion in contact with one of the conductive pads, the contact portion of each of the conductive terminals has a second virtual center line, the row of conductive terminals comprises at least one terminal group, and each of the at least one terminal group comprises two of the ground terminals and one pair of the at least one pair of differential signal terminals located between the two of the ground terminals;

wherein in each of the at least one terminal group, a pitch between the two contact portions of the one pair of differential signal terminals is defined as a first pitch, a pitch between the contact portion of each differential signal terminal of the one pair of differential signal terminals and the contact portion of a corresponding one of the two of the ground terminals adjacent thereto is defined as a second pitch, the first pitch is less than the second pitch, and the second virtual center line of the contact portion of each of the conductive terminals is offset in the elongated direction from the first virtual center line of a corresponding one of the conductive pads toward a location between the contact portions of the one pair of differential signal terminals; and wherein another ground terminal of the ground terminals is provided to be adjacent to each of the at least one terminal group, a pitch between the contact portion of the another ground terminal and the contact portion of an adjacent one of the two of the ground terminals in each of the at least one terminal group is defined as a third pitch, and the third pitch is greater than the second pitch.

15. The connector assembly according to claim 14, wherein the differential signal terminals and the ground terminals have identical structures.

16. The connector assembly according to claim 15, wherein each of the conductive terminals further has a conductive portion configured to be in contact with a circuit board and a connecting portion connecting the contact portion and the conductive portion, and a pitch between the two conductive portions of two adjacent ones of the conductive terminals is equal to a pitch between the two contact portions of the two adjacent ones of the conductive terminals, and is also equal to a pitch between the two connecting portions of the two adjacent ones of the conductive terminals.

17. The connector assembly according to claim 16, wherein the conductive portion of each of the conductive terminals has a third virtual center line, the circuit board has a plurality of conduction pads provided in a row in the elongated direction, each of the conduction pads has a fourth virtual center line, the conductive portion of each of the conductive terminals is electrically connected to a corresponding one of the conduction pads, and in each of the at least one terminal group, the third virtual center line of the conductive portion of each of the conductive terminals is offset in the elongated direction from the fourth virtual center line of the corresponding one of the conduction pads toward the location between the contact portions of the one pair of differential signal terminals.

18. The connector assembly according to claim 17, wherein the second virtual center line and the third virtual center line are provided on a same plane.

19. The connector assembly according to claim 18, wherein the conductive terminals are symmetrical relative to the plane defined by the second virtual center line and the third virtual center line.

20. The connector assembly according to claim 14, wherein the mating component is an electronic card meeting with a Peripheral Component Interconnect Express (PCI-E) standard.

* * * * *